US005554043A

United States Patent [19]

Yamanashi

[11] Patent Number: 5,554,043

[45] Date of Patent: Sep. 10, 1996

[54] CONNECTOR FOR TRANSMISSION

[75] Inventor: Makoto Yamanashi, Shizuoka-ken, Japan

[73] Assignee: Yazaki Corporation, Tokyo, Japan

[21] Appl. No.: 281,272

[22] Filed: Jul. 27, 1994

[30] Foreign Application Priority Data

Jul. 28, 1993 [JP] Japan ..... 5-186116

[51] Int. Cl.[6] ..... H01R 13/627

[52] U.S. Cl. ..... 439/350

[58] Field of Search ..... 439/604, 350, 439/357

[56] References Cited

U.S. PATENT DOCUMENTS

| | | | |
|---|---|---|---|
| 3,824,523 | 7/1974 | McGhee | 439/350 |
| 4,634,204 | 1/1987 | Detter et al. | 439/352 |
| 4,842,540 | 6/1989 | Endo et al. | 439/271 |
| 4,915,643 | 4/1990 | Samejima et al. | 439/357 |
| 4,925,398 | 5/1990 | Samejima et al. | 439/350 |
| 4,955,815 | 9/1990 | Gate et al. | 439/350 |

FOREIGN PATENT DOCUMENTS 62-49877 3/1987 Japan .

*Primary Examiner*—P. Austin Bradley
*Assistant Examiner*—Jill DeMello
*Attorney, Agent, or Firm*—Wigman, Cohen Leitner & Myers, P.C.

[57] ABSTRACT

A connector for a transmission is disclosed. The connector includes a cylindrical part which is provided on one side thereof with a hood part for engaging with a mating connector, a substantially cylindrical transmission-case engaging part formed integral with an opposite side of the cylindrical part so that an outer diameter of the transmmission-case engaging part is larger than a diameter of the cylindrical part and at least one projection provided on a periphery of the cylindrical part for engaging with the other connector. The transmission-case engaging part has an opening formed at one end thereof and an inlet for pouring fluid sealant formed at the other end thereof. The inlet communicates with the opening through a penetration space extending along the periphery of the cylindrical part, and the projection is positioned over the penetration space.

6 Claims, 5 Drawing Sheets

CONNECTOR FOR TRANSMISSION

BACKGROUND OF THE INVENTION

This invention relates to a connector for transmission to be sealed by pouring a resin thereinto.

The conventional connectors similar to the connector of the Japanese Utility Model Laid Open No. 62-49877 are shown in FIGS. 1A and 1B, respectively. In these figures, FIG. 1A is a front view thereof and FIG. 1B is a sectional view taken along a line IB—IB of FIG. 1A.

As shown in these figures, the connector for transmission includes a cylindrical part 5 having a hood part 3 of rectangular section into which another connector (not shown) is inserted, and a transmission-case engaging part 7 which has a circular section of diameter larger than that of the cylindrical part 5 and which is formed integral therewith. Arranged at a connecting part of the cylindrical part 5 with the transmission-case engaging part 7 is an inlet 9 through which a fluid sealant, such as a resinous material, is poured into the connector 1 for transmission. The cylindrical part 5 is provided on an outer surface with projections 11 to be engaged with an engaging part of the other connector.

The cylindrical part 5 has a connector housing 13 which is formed integral with the hood part 3 and which is provided with six chambers 13*a* for terminals. In an assembled state, not-shown male terminals are respectively accommodated in the chambers 13*a* in such a manner that the respective leading ends of terminals project into the hood part 3. On the other hand, the respective rear ends of terminals are crimped to ends of electrical wires. Then, the electrical wires which extend from the rear ends of terminals are passed through the transmission-case engaging part 7 and drawn out, respectively.

The transmission-case engaging part 7 has one end connected to the cylindrical part 5 and the other end provided with an opening 15. Further, the part 7 is provided on an outer surface with a peripheral groove 17 into which an O-ring 19 is installed. On condition that the O-ring 19 is engaged with an internal wall of a mount hole 21*a* of a transmission case 21, the ring 19 serves as a seal between the internal wall and tile outer periphery of the part 7.

Inside the transmission-case engaging part 7 and at an intermediate position thereof, there is formed an engaging part 23 with which a rubber seal-plug is engaged. The sealant is poured between the rubber plug engaged with the part 23 and the connector housing 13 and is poured into the chambers 13*a* through the inlet 9.

Opening to a connecting part of the cylindrical part 5 with the transmission-case engaging part 7, the inlet 9 is formed so that the fluid sealant is not brought into contact with the leading end of the male terminal. The respective projections 11 project from an outer peripheral part of the cylindrical part 5 opposite to the inlet 9.

In order to form the above-mentioned connector 1 in a part from the resinous material, there are used four molding dies 25, 27, 29 and 31 as shown in FIG. 2A in which portions with mesh exhibit spaces corresponding to the connector 1 to be molded and shaded portions correspond to the above molding dies, respectively. In addition, four directions with four arrows A, B, C and D show directions along which the molding dies 25, 27, 29 and 31 are drawn after molding, respectively. In manufacturing, by injecting the resinous material into the spaces defined by an alignment of these molding dies, the connector 1 for transmission can be completed.

Regarding molding off the connector 1 by using such molding dies, if the projection 11 is arranged over the pouring inlet 9, the molding die 25 for forming the inlet 9 cannot be drawn in the direction of A (upward in FIG. 2A). This is a reason why the projection 11 is arranged opposite to the inlet 9 in the conventional connector 1. However, such an arrangement of the projections 11 causes an increasing in size of the whole cylindrical part 5, so that the connector 1 itself becomes large-sized.

Furthermore, since the molding die 31 is one to be drawn in the direction of D (left hand in FIG. 2A), it is impossible to form an inverse slant 33 toward each top of the projections 11 as shown with a dashed-line of FIG. 2B, which comes across the direction of D. Consequently, such a configuration of the projections 11 cannot offer a steady engagement (locking connection) of the connector 1 with the not-shown other connector. In order to solve such a problem, there is expected a countermeasure of increasing the height a (see FIG. 2B) of the projections 11. However, such an arrangement causes an increasing of the insertion force when engaging with the other connector, so that it becomes difficult to insert the other connector into the hood part 3, thereby causing the insertion to become worse.

Further, if the inlet 9 is formed to be smaller from point of view of miniaturizing the connector 1, there would be a problem in that it would be difficult to pour the sealant thereinto.

SUMMARY OF THE INVENTION

It is an object of the present invention to provide a leak-resistant transmission connector capable of increasing an engaging force with the other connector to be engaged.

It is another object of the present invention to provide a connector which is compact and capable of improving an operation to pour the sealant into the connector.

In order to achieve the above-mentioned object, the present invention provides a connector for transmission comprising:

a cylindrical part which is provided on one side thereof with a hood part for engaging with a mating connector, the cylindrical part having chambers for accommodating electrical terminals;

a transmission-case engaging part to be mounted in a mount hole formed in a transmission case; the transmission-case engaging part being formed integral with the other side of the cylindrical part and being formed to be substantially cylindrical so that an outer diameter of the transmission-case engaging part is larger than an outer diameter of the cylindrical part, the transmission-case engaging part having an opening formed at one axial end thereof and an inlet for pouring fluid sealant formed at the other axial end thereof, said inlet being arranged at a connecting part of the cylindrical part with the transmission-case engaging part;

at least one projection provided on a periphery of the cylindrical part for engaging with the mating connector; and a penetration space for providing communication between the inlet and the opening of the transmission case engaging part, the penetration space extending along the periphery of the cylindrical part;

wherein the projection is arranged over the penetration space.

In the present invention, since the leak-resistant transmission connector is provided with the penetration space which is in fluid communication with the inlet through which the fluid sealant is flowed into the opening of the transmission-case engaging part, it is possible to extend the leading end of the molding die for molding the penetration space up to a top of the projection. Consequently, if only a slant is formed in the leading end, it is possible to form an inverse slant toward the top of the projection, thereby improving the engaging force with the other connector to be connected with the present connector.

These and other objects and features of the present invention will become more fully apparent from the following description and appended claims taken in conjunction with the accompanying drawings.

BRIEF DESCRIPTION OF THE DRAWING

FIGS. 1A and 1B show conventional leak-resistant transmission connector, in which FIG. 1A is a plan view thereof and FIG. 1B is a cross-sectional view taken along the line IB—IB of FIG.1A;

FIGS. 2A and 2B show molding dies for forming the conventional, leak-resistant transmission connector, in which FIG. 2A is a cross-sectional view of the molding dies and FIG. 2B is an enlarged view of an engaging projection in FIG. 2A;

FIGS. 3A and 3B show a leak-resistant transmission connector according to the present invention, in which FIG. 3A is a plan view thereof and FIG. 3B is a cross-sectional view taken along the line IIIB—IIIB of FIG. 3A;

FIGS. 5A and 5B show molding dies for forming the connector for transmission in accordance with the present invention, in which FIG. 5A is a cross-sectional view of the molding dies and FIG. 5B is an enlarged view of an engaging projection in FIG. 5A.

DESCRIPTION OF THE PREFERRED EMBODIMENT

Figure 1A:
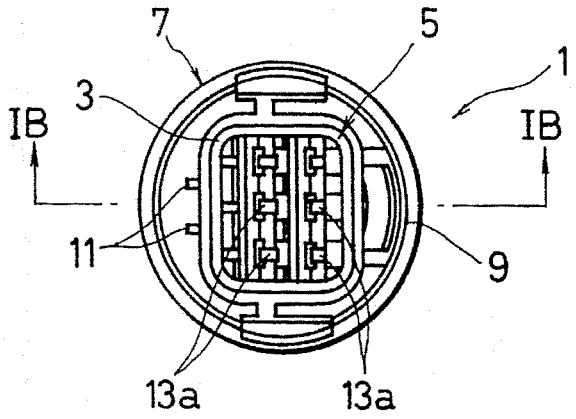
FIG. 1A PRIOR ART
Figure 1B:
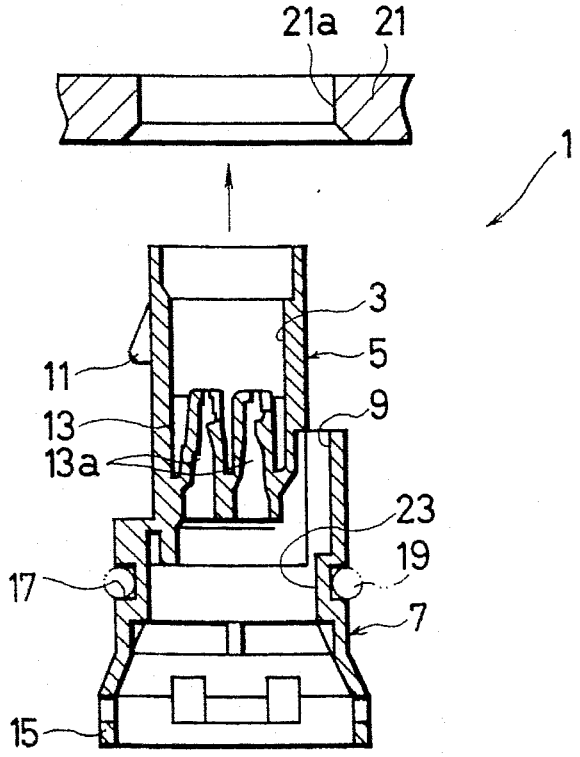
FIG. 1B PRIOR ART
Figure 2A:
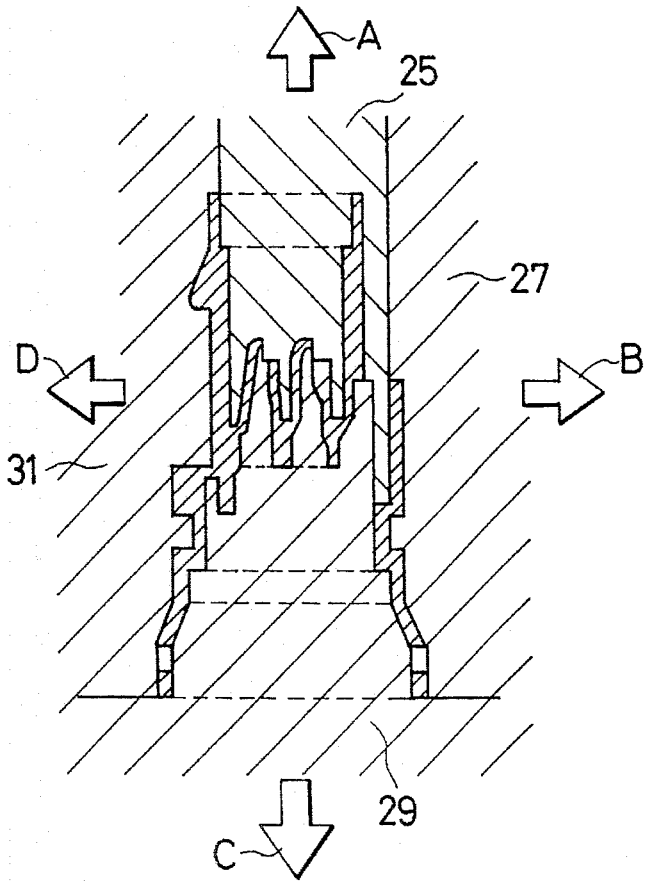
FIG. 2A PRIOR ART
Figure 2B:
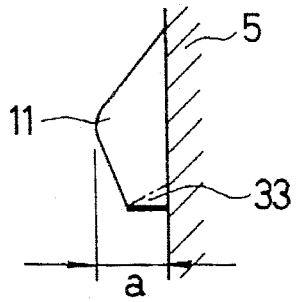
FIG. 2B PRIOR ART

Referring to the drawings, a preferred embodiment of the present invention will now be described.

Figure 3A:
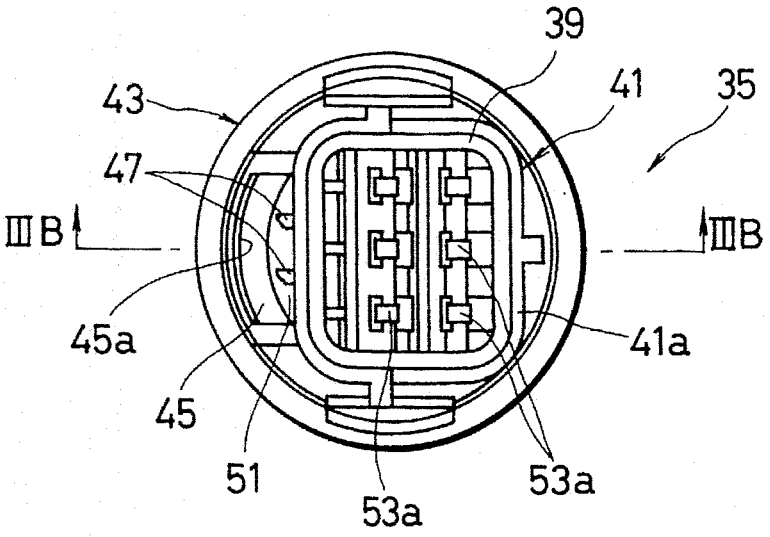
Figure 3B:
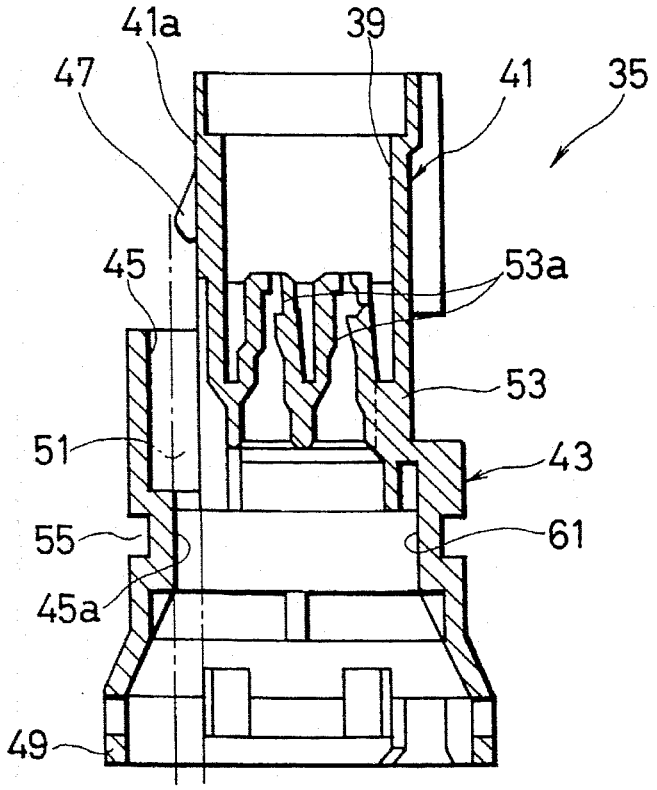
Figure 4:
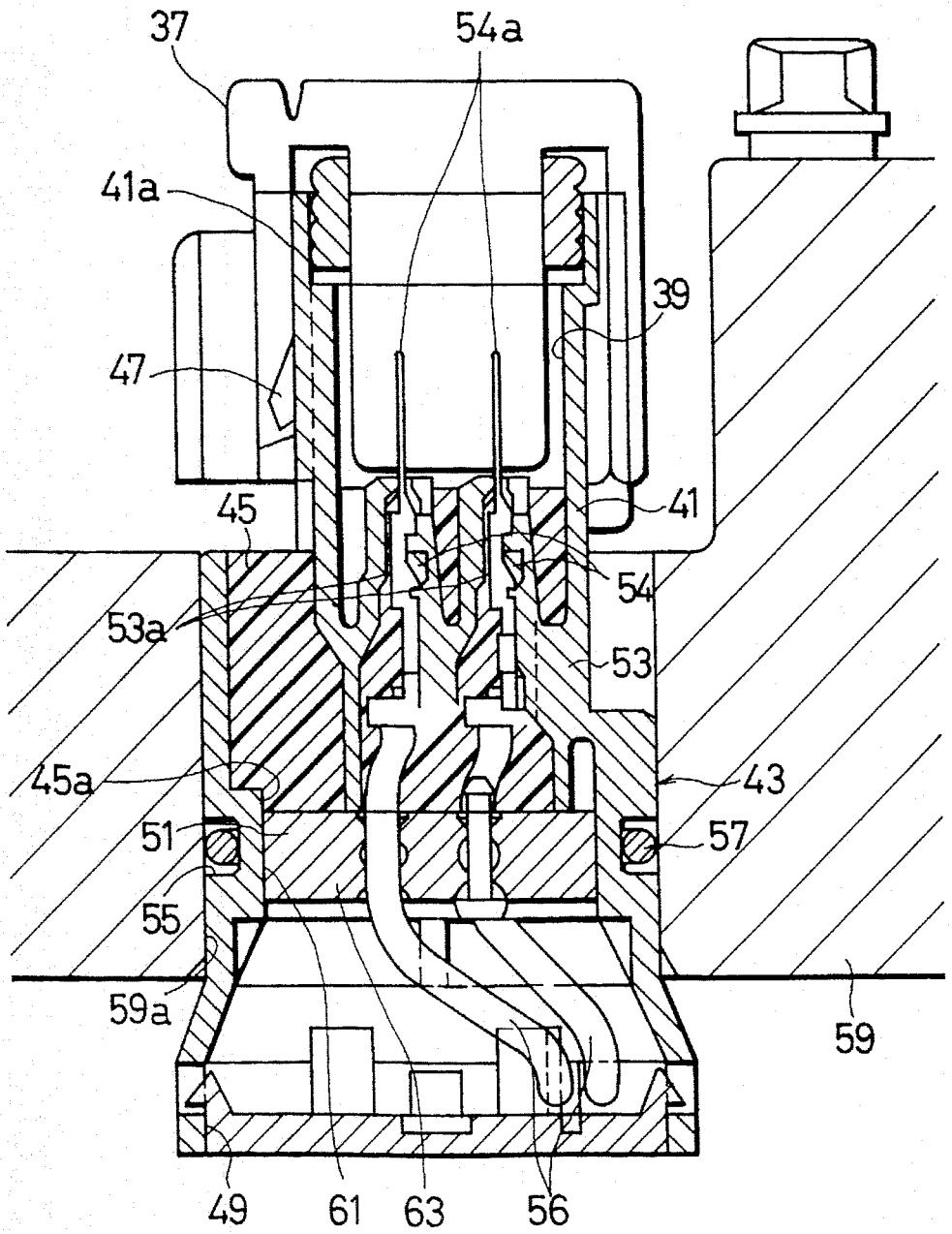
FIG. 4 is a cross-sectional view showing the leak-resistant transmission connector according to the present invention, which is mounted on a transmission casing.

As shown in FIGS. 3A and 3B, a leak-resistant transmission connector 35 of the present invention includes a cylindrical part 41 having a hood part 39 of rectangular cross-section into which a male connector 37 (see FIG. 4) is inserted, and a transmission-case engaging part 43 formed integral with the part 41. The transmission-case engaging part 43 is shaped to be substantially cylindrical to have an outer diameter larger than that of the cylindrical part 41.

Arranged at one end of the transmission-case engaging part 43 in the axial direction and at a connecting part thereof with the cylindrical part 41 is an inlet 45 through which a fluid sealant, such as a resinous material, is poured into the leak-resistant transmission connector 35. The cylindrical part 41 is provided on a periphery thereof with two projections 47 to be engaged with an engaging part of the other connector 37. Further, the transmission-case engaging part 43 is also provided with a penetration space 51 which extends along a peripheral surface 41*a* of the cylindrical part 41 to communicate the inlet 45 with an opening 49 formed at the other end of the part 43 in the axial direction. In an arrangement, the projections 47 are arranged over the penetration space 51.

The cylindrical part 41 has a connector housing 53 which is formed integral with the hood part 39 and which is provided with four chambers 53*a* for accommodating electrical terminals. In an assembled state shown in FIG. 4, male electrical terminals 54 are respectively accommodated in the chambers 53*a* in such a manner that the respective leading ends of the terminals 54 project into the hood part 39. On the other hand, the near ends of the male terminals 54 are crimped and electrically connected to ends of electrical wires 56, respectively. Then, the electrical wires 56 which extend from the rear ends of the male terminals 54 are passed through the transmission-case engaging part 43 and drawn out, respectively.

As described above, the transmission-case engaging part 43 is connected to the cylindrical part 41 at one axial end thereof. The part 43 is provided on the other axial end with the opening 49. Further, the transmission-case engaging part 43 is provided on a periphery thereof with a peripheral groove 55 into which an O-ring 57 is installed. In the assembled state, the O-ring 57 bears upon an internal wall of a mount hole 59*a* of a transmission case 59, thereby serving as a seal structure between the internal wall of the transmission case 59 and the periphery of the part 43.

Inside the transmission-case engaging part 43 and at an intermediate position thereof, there is formed an engaging part 61 to which a rubber plug 63 for providing a seal is fitted. The resinous material for providing a seal is poured into a space defined by the rubber plug 63 on the engaging part 61 and the connector housing 53 and into the chambers 53*a* through the inlet 45. Opening to a connecting part of the cylindrical part 41 with the transmission-case engaging part 43, the inlet 45 is formed so that the poured sealant is not brought into contact with the leading end of the male terminal. The penetration space 51 is arranged between the utmost inside wall 45*a* of the inlet 45 and the peripheral surface 41*a* of the cylindrical part 41 so as to extend along the peripheral surface 41*a* of the cylindrical part 41, thereby communicating the inlet 45 with the opening 49. And, the projections 47 project from the peripheral surface 41*a* over the penetration space 51.

Figure 5A:
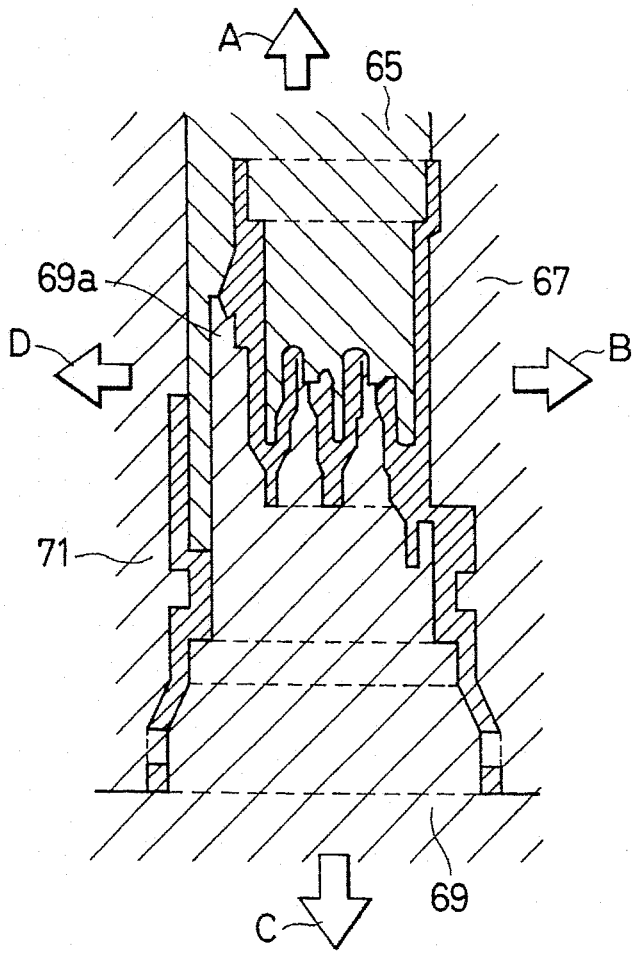
Figure 5B:
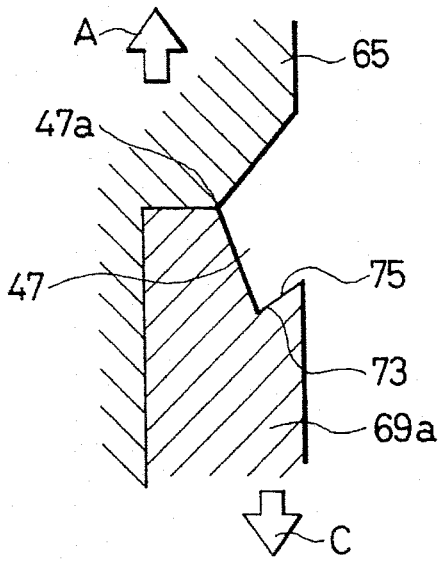

In order to mold such a leak-resistant transmission connector 35 in a part from the resinous material, four molding dies 65, 67, 69 and 71 shown in FIG. 5A are used. Note that, in FIG. 5A, portions with mesh exhibit spaces corresponding to the leak-resistant transmission connector 35 to be molded on one hand. On the other hand, shaded portions correspond to the above molding dies, respectively. In addition, four directions with four arrows A, B, C and D show directions along which the molding dies 65, 67, 69 and 71 are drawn after molding, respectively. In this arrangement, the molding die 65 is positioned so as to face the die 69 and the die 67 is positioned so as to face the die 71. During molding, by injecting the resinous material into the spaces defined by the molding dies 65, 67, 69 and 71 under the assembled condition, the leak-resistant transmission connector 35 can be completed.

Then, a leading end 69*a* of the molding die 69 for defining the penetration space 51 is formed to extend up to the utmost projecting parts (tops) 47*a* of the projections 47, at which the molding die 69 engages with the other molding die 65. Furthermore, the molding die 69 is provided in the end 69*a* with a slant 75 for forming an inverse slant 73 toward the tops of the projections 47.

In this way, since the leak-resistant transmission connector 35 according to the present invention is provided with the penetration space 51 which is in fluid communication with the inlet 45 through which the fluid sealant is flowed into the opening 49 of the transmission-case engaging part 43, it is possible to extend the leading end 69*a* of the molding die 69 for defining the penetration space 51, up to each top 47*a* of the projections 47. Consequently, if only forming the slants 75 in the leading end 69*a*, it is possible to form the inverse slants 73 toward the tops 47*a* of the projections 47, respectively, thereby improving the engaging force of the connector 35 with the other connector 37 to be engaged therewith.

In addition, by positioning the projections 47 in the penetration space 51, it is possible to arrange the projection 47 on the peripheral surface 41*a* of the cylindrical part 41 and on the same side as the inlet 45, whereby the miniaturization of the cylindrical part 41 can be attained. Furthermore, by providing the penetration space 51 communicating with tile inlet 45 for pouring the sealant, it is possible to increase the opening area thereof, whereby the workability in pouring the material can be improved. It should be understood that present invention is not limited to the particular embodiment shown and described above, and various changes and modifications may be made without departing from the spirit and scope of the appended claims.

What is claimed is:

1. A connector for a transmission, comprising:

a cylindrical part which is provided on a first axial end thereof with a hood part for engaging with a mating connector, said cylindrical part having chambers for accommodating electrical terminals;

a transmission-case engaging part to be mounted in a mount hole formed in a transmission case, said transmission-case engaging part being formed integral with a second axial end opposite the first axial end of said cylindrical part and being formed to be substantially cylindrical so that an outer diameter of said transmission-case engaging part is larger than an outer diameter of said cylindrical part, said transmission-case engaging part having an opening formed at a first axial end thereof and an inlet for pouring fluid sealant formed at a second axial end thereof, said inlet being arranged at a connecting part of said cylindrical part with said transmission-case engaging part;

at least one projection provided on a periphery of said cylindrical part for engaging with the mating connector; and a penetration space defining a flowpath for the fluid sealant between the cylindrical part and the transmission-engaging part, the flowpath extending from said opening of said transmission-case engaging part at said first axial end thereof along the periphery of said cylindrical part;

wherein said at least one projection is arranged along an axial extent of the cylindrical part substantially in-line with said penetration space, and said at least one projection comprises a first edge portion extending between a first point and a second point, said first point being nearer to said first axial end of said cylindrical part than said second point is, said at least one projection further comprising a second edge portion which is inversely slanted and extends between said second point and a third point, said third point being nearer to said first axial end of said cylindrical part than said second point is, whereby said second edge portion of said at least one projection and said penetration space can be formed by a single molding die simultaneously, said molding die being drawn in an axial direction of said transmission-case engaging part after molding.

2. A connector for a transmission as claimed in claim 1, wherein said transmission-case engaging part is provided on a periphery thereof with a peripheral groove for accommodating an O-ring therein.

3. A connector for a transmission as claimed in claim 2, further comprising a rubber plug for sealing an inside of said transmission-case engaging part, wherein said rubber plug is arranged in said transmission-case engaging part at an axially intermediate position thereof.

4. A connector for a transmission as claimed in claim 3, wherein said fluid sealant is poured into a space defined between said inlet and said rubber plug.

5. A connector for a transmission as claimed in claim 1, wherein said first edge portion comprises a first sub-portion and a second sub-portion, said first sub-portion extending from said first point to a fourth point intermediate between said first and second points and said second sub-portion extending from said fourth point to said second point.

6. A connector for a transmission as claimed in claim 5, wherein said fourth point is more distant from a center line of said cylindrical part than said first and second points are.

* * * * *